US008408316B2

(12) United States Patent
Nutley et al.

(10) Patent No.: US 8,408,316 B2
(45) **Date of Patent: *Apr. 2, 2013**

(54) DOWNHOLE APPARATUS WITH A SWELLABLE SUPPORT STRUCTURE

(75) Inventors: Kim Nutley, Inverurie (GB); Brian Nutley, Aberdeen (GB)

(73) Assignee: Swelltec Limited, Dyce, Aberdeen (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/407,449

(22) Filed: Feb. 28, 2012

(65) Prior Publication Data

US 2012/0152568 A1 Jun. 21, 2012

Related U.S. Application Data

(63) Continuation of application No. 13/035,644, filed on Feb. 25, 2011, now Pat. No. 8,151,894, which is a continuation of application No. 12/470,412, filed on May 21, 2009, now Pat. No. 7,896,085, which is a continuation of application No. PCT/GB2007/004453, filed on Nov. 21, 2007.

(30) Foreign Application Priority Data

Nov. 21, 2006 (GB) ..... 0623138.5
May 31, 2007 (GB) ..... 0710365.8

(51) Int. Cl.
*E21B 33/12* (2006.01)

(52) U.S. Cl. ..... 166/380; 166/207

(58) Field of Classification Search ..... 166/380, 166/384, 207, 180
See application file for complete search history.

(56) References Cited

U.S. PATENT DOCUMENTS 2,780,294 A 2/1957 Loomis
3,036,639 A 5/1962 Baker
3,038,542 A 6/1962 Loomis
4,397,351 A 8/1983 Harris
4,452,463 A 6/1984 Buckner
4,745,972 A 5/1988 Bell et al.
4,765,404 A 8/1988 Bailey et al.
4,852,394 A 8/1989 Goans
4,892,144 A 1/1990 Coone
5,027,894 A 7/1991 Coone
5,103,904 A 4/1992 Luke et al.
5,176,217 A 1/1993 Luke et al.
5,311,938 A 5/1994 Hendrickson et al.
5,433,269 A 7/1995 Hendrickson
5,540,279 A 7/1996 Branch et al.
5,603,511 A 2/1997 Keyser, Jr. et al.
(Continued)

FOREIGN PATENT DOCUMENTS

EP 1437480 7/2004
WO 99/49180 9/1999
(Continued)

OTHER PUBLICATIONS

International Written Opinion and Search Report regarding corresponding application No. PCT/GB2007/004453, dated Mar. 18, 2008.

*Primary Examiner* — William P Neuder
(74) *Attorney, Agent, or Firm* — Wong, Cabello, Lutsch, Rutherford & Brucculeri LLP

(57) ABSTRACT

A downhole apparatus having a radially expanding portion and a support structure are described. The support structure comprises an attachment means for coupling to the apparatus and a support portion configured to be deployed from a first unexpanded condition to a second expanded condition by expansion of the apparatus. In one aspect of the invention, the downhole apparatus is expanded by exposing the swellable material to at least one predetermined fluid, and the support structure abuts the swellable material in its expanded form. A method of use and its application to a well packer, a hanging member, an anchor and a centralising apparatus are described.

54 Claims, 7 Drawing Sheets

U.S. PATENT DOCUMENTS

| | | | |
|---|---|---|---|
| 5,701,959 | A | 12/1997 | Hushbeck et al. |
| 6,102,117 | A | 8/2000 | Swor et al. |
| 6,167,963 | B1 | 1/2001 | McMahan et al. |
| 6,318,460 | B1 | 11/2001 | Swor et al. |
| 6,581,682 | B1 | 6/2003 | Parent et al. |
| 6,598,672 | B2 | 7/2003 | Bell et al. |
| 6,695,051 | B2 | 2/2004 | Smith et al. |
| 6,840,328 | B2 | 1/2005 | McKee et al. |
| 7,290,603 | B2 | 11/2007 | Hiorth et al. |
| 7,373,973 | B2 | 5/2008 | Smith et al. |
| 7,661,471 | B2 | 2/2010 | Murray et al. |
| 7,806,193 | B2 | 10/2010 | Berzin et al. |
| 7,938,176 | B2 | 5/2011 | Patel |
| 2008/0110626 | A1 | 5/2008 | Allison et al. |

FOREIGN PATENT DOCUMENTS

| | | |
|---|---|---|
| WO | 2006/121340 | 11/2006 |

DOWNHOLE APPARATUS WITH A SWELLABLE SUPPORT STRUCTURE

CROSS-REFERENCE TO RELATED APPLICATIONS

This application is a continuation of U.S. patent application Ser. No. 13/035,644, filed Feb. 25, 2011, now U.S. Pat. No. 8,151,894 which is a continuation of U.S. patent application Ser. No. 12/470,412, filed May 21, 2009, issuing as U.S. Pat. No. 7,896,085 on Mar. 1, 2011, which is CON of PCT/GB2007/004453 filed Nov. 21, 2007, which claims priority to PCT application WO 2008/062186 A1, filed Nov. 21, 2007, which in turn claims priority to United Kingdom Patent Application No. GB0623138.5, filed on Nov. 21, 2006 and United Kingdom Patent Application No. GB0710365.8, filed on May 31, 2007, all of which are incorporated by reference in their entirety for all purposes.

FIELD OF THE INVENTION

The present invention relates to downhole apparatus for use in hydrocarbon wells, and more particularly to a support structure for a downhole apparatus having a radially expanding member. In various aspects, the invention relates to an apparatus for use in applications to the centralising of downhole tubulars and components, and isolation tools such as well packers.

BACKGROUND

In the fields of wellbore construction and intervention, swellable tools are used to provide isolation between two regions in an annulus formed between an exterior surface of a tubular and an interior surface of well casing or a wellbore. A swellable member is formed from an elastomeric material selected to swell when placed in certain fluids. Where the swellable member swells in oil, the member may comprise ethylene propylene diene monomer rubber (EPDM). Where the swellable member swells in water, the member may comprise an N-vinylcarboxylic acid amide-base cross-linked resin and a water swellable urethane in an ethylene-propylene rubber matrix.

Applications of swellable tools are limited by a number of factors including: their capacity for swelling, their ability to create a seal, and their mechanical properties when in their unexpanded and expanded states. Swellable packers, for example, may be exposed to high pressure differentials across the packer. The integrity of the annular seal created by a well packer is paramount, and extrusion or deformation of the expanding portion will result in a potential failure mode between the apparatus and the bore wall. In practice therefore, swellable tools are designed to take account of the limitations of the materials. For example, a swellable packer may be run with an outer diameter only slightly smaller than the borehole, to limit the percentage volume increase of the swellable material during expansion. In addition, swellable packers may tend to be long compared with mechanical or hydraulic isolation tools in order to the pressure rating and/or reduce the chances of breach in the seal at high differential pressures.

SUMMARY

It is an aim of an aspect of the invention to provide downhole apparatus which mitigates the problems of swellable tools described above. It is an aim of an aspect of the invention to provide an alternative or improved support structure for use with downhole apparatus. Additional aims and objects of the invention will become apparent from the following description.

According to the first aspect of the invention, there is provided a support structure for a downhole apparatus having a radially expanding portion comprising a swellable material selected to expand on exposure to at least one predetermined fluid, the support structure comprising an attachment means for coupling to the apparatus and a support portion, wherein the support structure has a first unexpanded condition and a second expanded condition, and is adapted to be deployed to its second expanded condition by expansion of the radially expanding portion of the apparatus.

The support structure may be configured to couple the apparatus to a tubular, and may couple the apparatus to a tubular via the attachment means. The attachment means may be configured to be coupled to a body of the apparatus, and may be coupled to the apparatus at a portion of the body axially separated from or adjacent the radially expanding portion. The support structure is preferably adapted to act against axial and/or shear forces experienced by the apparatus. Such forces may be directed through the radially expanding portion. More preferably, the support structure is adapted to reduce extrusion of the radially expanding member due to axial and/or shear forces. The support structure may be adapted to be further deployed by axial and/or shear forces experienced by the apparatus. The support structure may be configured to abut against a surface of the swellable member before and during expansion of the swellable member. The support structure may be configured to abut against a portion of the surface of the radially expanding member. Preferably, the support structure is arranged to at least partially surround an end of the radially expanding member. The support structure may substantially cover an end of the radially expanding member. The support structure may extend along a part of a length of the radially expanding member.

Alternatively or in addition, the support structure may comprise a plurality of rigid support members that are configured for movement in relation to each other to accommodate expansion of the radially expanding member. More specifically, where the radially expanding member is of cylindrical form and defines a longitudinally extending bore, the plurality of rigid support members may be moveable in a radial direction.

The support structure may define a substantially cylindrical sheath in its first condition. The support structure may have an internal profile to accommodate the radially expanding member in its unexpanded condition. The internal profile may be frusto-conical with a first cone angle. The support structure may define an expanded sheath in its second condition, and may comprise a frusto-conical portion. The frusto-conical portion may have a second cone angle greater than the first cone angle. The support structure may comprise a substantially cylindrical attachment portion on which the attachment means is located. The support portion may be adapted to expand to accommodate expansion of the radially expanding member.

The support portion may comprise a plurality of support members, or leaves, arranged to be moveable with respect to one another to accommodate expansion of the radially expanding member. The support members may be circumferentially arranged on the attachment portion, and may be arranged to extend longitudinally with respect to the attachment portion.

Preferably, the support members are arranged to pivot with respect to the attachment portion. Thus a distal end of the support member moves radially with respect to the attachment portion, and the circumferential arrangement of support members may thereby define a frusto-conical support.

Preferably, the support structure includes a first inner layer of support members arranged circumferentially on the support structure, and a second outer layer of support members arranged circumferentially on the support structure, and disposed around the first inner layer. The first and second layers may be arranged such that the support members of the respective layers overlap such that their edges do not coincide. The support members of the respective layers may be arranged such that they are circumferentially displaced with respect to one another. In this way, the arrangement may be such that there is no direct path from an inner volume defined by the support portion and an outer surface of the support portion.

The support structure may further comprise a lining, which may be disposed between the apparatus and the support portion in use. The lining may comprise one or more layers, which may be of a flexible material such as a plastic. The lining preferably includes multiple layers. The lining may be adapted to accommodate expansion of the radially expanding member. The lining may be adapted to separate the radially expanding member and the support portion, and may extend from the attachment portion to the distal end of the support members. The lining may extend beyond the distal end of the support members.

The lining may comprise a plurality of leaves, and may include a plurality of layers, each including a plurality of leaves. The plurality of layers may be arranged such that gaps between leaves in a first layer do not coincide with gaps between leaves in a second layer. In this way, the arrangement may be such that any path through gaps between the leaves is convoluted.

The support portion may be arranged such that a force experienced from the expanding portion tends to move the support portion radially outward of the apparatus. The support portion may be arranged such that an axial force on the apparatus may further deploy the support structure. The support portion may comprise a bearing portion adapted to bear against the inside surface, for example a wall, lining or casing, of a bore in which the support structure is located. The bearing portion may be arranged to abut the wall or lining and thereby mitigate or prevent extrusion of the radially expanding member between the support structure and the wall, lining or casing.

The support portion may comprise one or more formations defining the bearing portion. The formation may be adapted to allow the support portion to at least partially conform to the shape of the wall, lining or casing. The formation may be configured to promote bending, flexing, folding or deforming of the support portion. The formation may be provided on one or more of the support members. The formation may be a groove or weakened portion extending circumferentially of the support structure.

The apparatus may comprise a connector, and the support structure may be configured to be coupled to the connector. The connector may be configured to be disposed on a tubular, and may comprise a first portion and a retaining portion. The first portion may be a mating portion and may comprise a mating profile for coupling to a corresponding profile in the body or radially expanding portion of the apparatus. The first portion may be configured to rotate on a tubular.

The apparatus may be configured to rotate on the tubular. The retaining portion may be configured to restrict axial movement of the support structure and/or apparatus on the tubular. The first portion and the support structure may be configured to rotate together in use.

According to second aspect of the invention, there is provided a downhole assembly comprising a downhole apparatus and at least one support structure in accordance with the first aspect of the invention.

The apparatus may comprise a connector, and the support structure may be configured to be coupled to the connector. The connector may be configured to be disposed on a tubular, and may comprise a first portion and a retaining portion. The first portion may be a mating portion and may comprise a mating profile for coupling to a corresponding profile in the body or radially expanding portion of the apparatus. The first portion may be configured to rotate on a tubular.

The apparatus may be configured to rotate on the tubular. The retaining portion may be configured to restrict axial movement of the support structure and/or apparatus on the tubular. The first portion and the support structure may be configured to rotate together in use.

The apparatus may be selected from a well packer, a hanging member, an anchor and a centralising apparatus.

According to a third aspect of the invention, there is provided a method of expanding an apparatus in a wellbore, the method comprising the steps of: providing the apparatus at a downhole location in a first, unexpanded condition; effecting the expansion of an expanding portion of the apparatus by exposing it to at least one predetermined fluid selected to swell the expanding portion, such expansion thereby deploying a support structure to an expanded condition in which it provides support to the expanding portion.

According to a fourth aspect of the invention, there is provided a downhole apparatus comprising a body, an expanding portion disposed on the body, and a support structure coupled to the body and arranged to abut a part of the expanding portion, wherein expansion of the expanding portion effects movement of the support structure to an expanded condition in which it provides support to the expanding portion.

The apparatus may be any apparatus having an expanding portion, including but not restricted to a well packer or other annular seal, a hanging member or anchor, or a centralising apparatus. Further embodiments of the fourth aspect of the invention may comprise one or more features according to the first or second aspects of the invention and their embodiments.

According to a further aspect of the invention, there is provided a support structure for a downhole apparatus having a radially expanding portion, the support structure comprising an attachment means for coupling to the apparatus and a support portion arranged to abut the radially expanding portion of the apparatus, wherein the support portion is arranged to be moved by expansion of the apparatus to an expanded condition in which it provides support to the expanding member. Preferably, the radially expanding portion comprises a swellable material selected to expand on exposure to at least one predetermined fluid.

Further embodiments of the further aspects of the invention may comprise one or more features according to the first, second or fourth aspects of the invention and their embodiments.

DETAILED DESCRIPTION

Figure 1B:
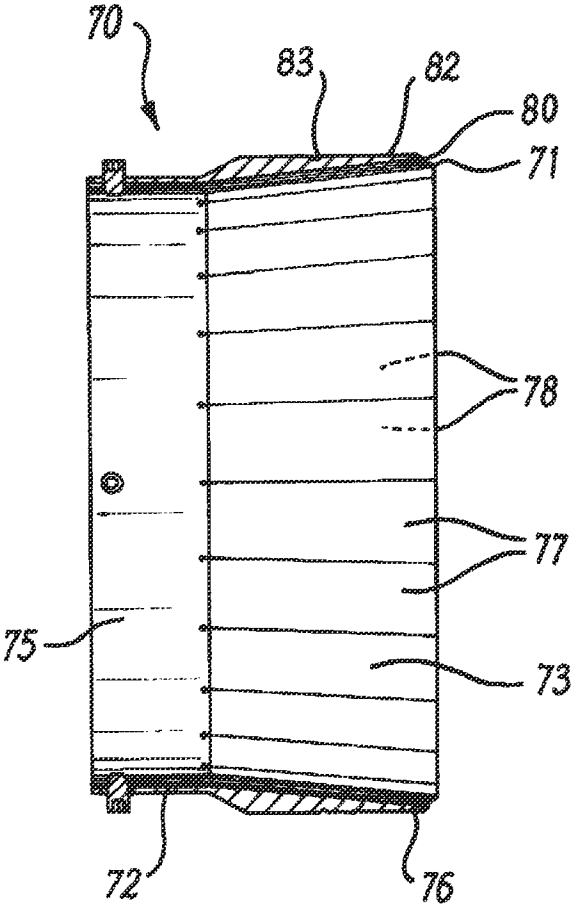
FIGS. 1A and 1B are, respectively, perspective and part-sectional views of a support structure in accordance with an embodiment of the invention.
Figure 1A:
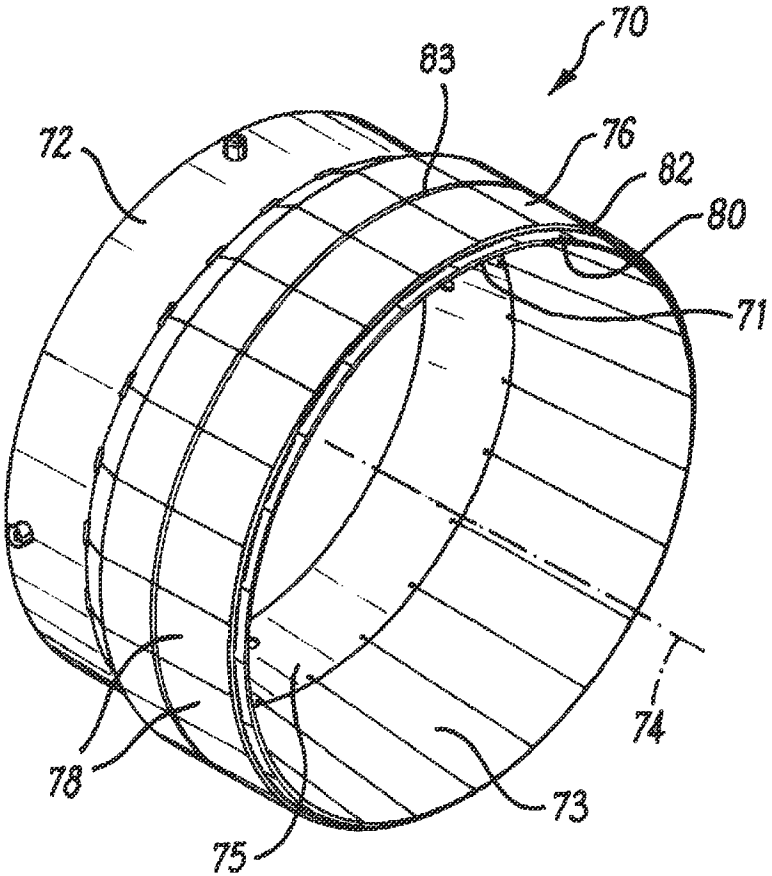

Referring firstly to FIGS. 1A and 1B, there is shown respectively in perspective and part-sectional views, a support structure, generally shown at 70. The support structure 70 is formed from a metal such as steel. The support structure 70 is configured for use with a downhole tool having a swellable member or mantle.

The support structure comprises a first cylindrical portion 72 which defines a bore 74 sized such that the support structure can be slipped over a tubular which forms a part of the apparatus with which the support structure is used. The support structure 70 comprises an expanding support portion 76 consisting of a plurality of support members in the form of leaves 78. The leaves 78 are circumferentially distributed around the support structure 70 in two layers. The first, inner layer 80 is located inside a second, outer layer 82. The outer layer 82 defines the outer surface of the expanding portion 76, and surrounds and overlays the inner layer 80. The layers 80, 82 therefore define concentric rings of leaves 78 on the expanding support portion 76.

The leaves 78 consist of longitudinally extending portions or members which are connected to the cylindrical portion 72 such that a degree of pivoting of the leaves is permitted relative to the cylindrical portion 72. The leaves 78 are disposed such that the edges of the leaves in the inner layer are displaced relative to the edges of the leaves on the outer layer. That is, the gaps between adjacent leaves in the inner layer 80 are misaligned with the gaps between adjacent leaves in the outer layer 82.

The leaves 78 are provided with grooves 83 in their outer surface. The grooves 83 extend across the leaves in the circumferential direction of the support structure, and adjacent grooves are aligned such that together they define a continuous circumferential groove around the structure. A similar arrangement of grooves (not shown) is provided on the inner layer of leaves. The grooves 83 provide a line about which the leaves may tend to deform or fold in certain conditions.

Around the inner surface of the support structure is provided a flexible lining 71 comprising a plurality of plastic layers 73. The plastic layers 73 are each cut from a flexible plastic sheet, and consist of a rectangular band 75 sized to fit in the cylindrical portion 72, and a plurality of flexible leaves 77. The flexible leaves are sized to extend slightly beyond the leaves 78 of the expanding portion. Opposing ends of the plastic layers 73 are joined to create a cylindrical shape that fits within the support structure. The plastic layers overlap one another to provide a multi-ply flexible lining. Edges of the flexible leaves in successive plastic layers are displaced relative to one another, such that the gaps between adjacent layers are misaligned.

Figure 2C:
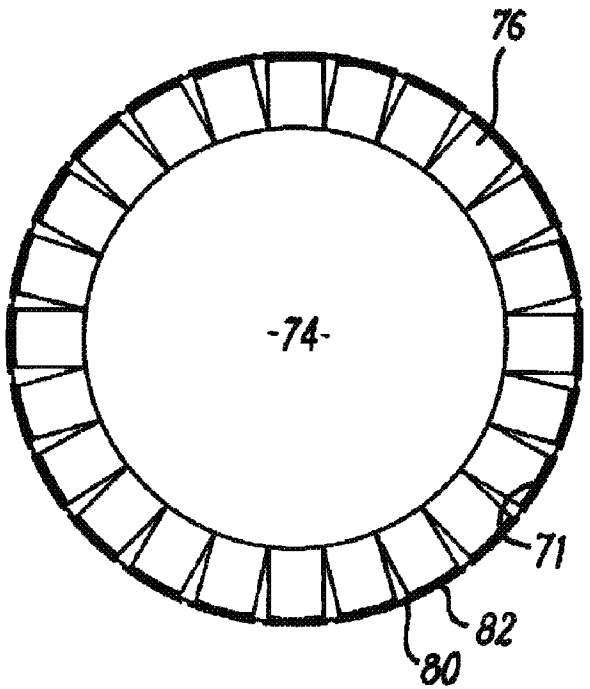
FIGS. 2A, 2B, and 2C are, respectively, perspective, part-sectional, and end views of the support structure of FIGS. 1A and 1B in an expanded condition.
Figure 2B:
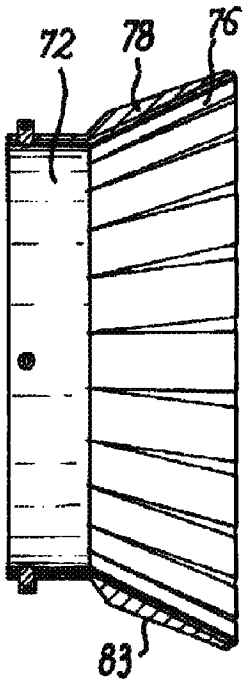
Figure 2A:
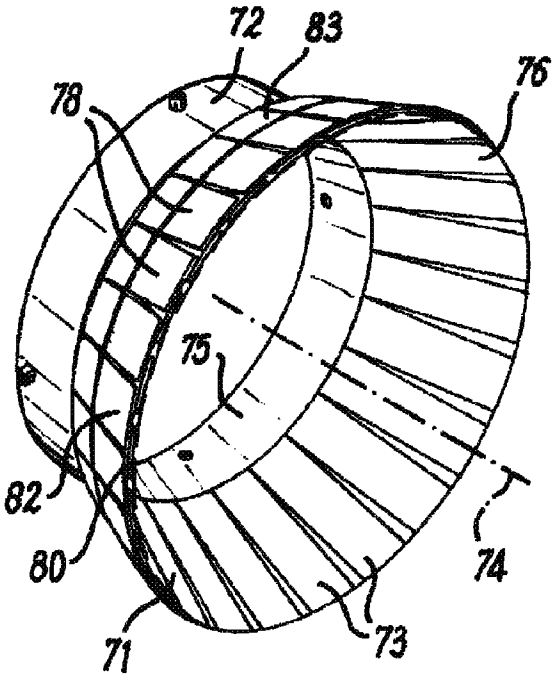

FIGS. 2A, 2B and 2C show, respectively, in perspective, part-sectional, and end views the support structure 70 in an expanded condition. The leaves 78 have been allowed to pivot radially outwardly about their connections with the cylindrical portion 72, such that they define a frusto-conical portion 84. The overlapping arrangement of the leaves in the inner layer 80 and outer layer 82 ensures that there is no direct path through the expanding portion 76 from the inner volume defined by the support structure to the outer surface. The flexible leaves 77 of the plastic layers 73 similarly flex outwards, and the misalignment of the edges increases the convoluted, tortuous path from the inner volume to the outer surface. The plastic leaves are also able to flex or deform into the gaps created by the expansion of the leaves 78.

FIGS. 3, 4, 5A and 5B show the support structure 70 in use in a well packer assembly, generally depicted at 10. The assembly consists of an apparatus having a swellable member 14, and a pair of end connectors 12 mounted on a tubular 16, and a pair of support structures 70. The swellable member 14 is formed as a single moulded piece from a material selected to expand upon exposure to a predetermined fluid. The swellable member is formed from a material which is selected to expand on contact with a predetermined fluid. Such swellable materials are known in the art. In this example, the swellable member is required to swell in oil, and the material comprises ethylene propylene diene monomer rubber (EPDM).

The end connector 12 comprises a mating portion 18 and a retaining portion 20, which in this example are of unitary construction. The mating portion 18 is of a generally cylindrical shape such that it defines a bore to be slipped onto the tubular of the apparatus. The retaining portion 20 also has fixing means in the form of bolts 48 that threadedly engage with bores 49 at locations spaced apart circumferentially around the external surface to secure the connector to the tubular.

The mating portion 18 comprises an extended cylindrical surface 19 on which the support structure 70 is mounted by means of bolts. Retaining ring 21 is provided over the cylindrical portion 72 of the support structure 70.

The cylindrical portion 72 of the support structure 70 is secured to the end connector 12, and the expanding portion 76 is arranged to partially surround the swellable member 14. The swellable member 14 is profiled to accommodate the expanding portion 76, and such that the outer profile of the support structure 70 is flush or recessed with respect to the maximum outer diameter of the swellable member 14. The support structure is configured to abut against an external surface of a swellable member when the swellable member is in an unexpanded condition, and to remain in contact with the external surface during expansion and after the swellable member has expanded.

Figure 5A:
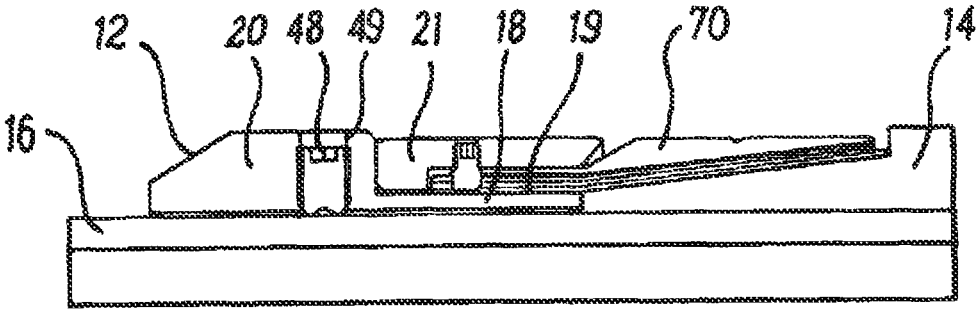
FIG. 5A is a detail of a longitudinal section through the well packer of FIGS. 3 and 4 in an unexpanded condition.
Figure 5B:
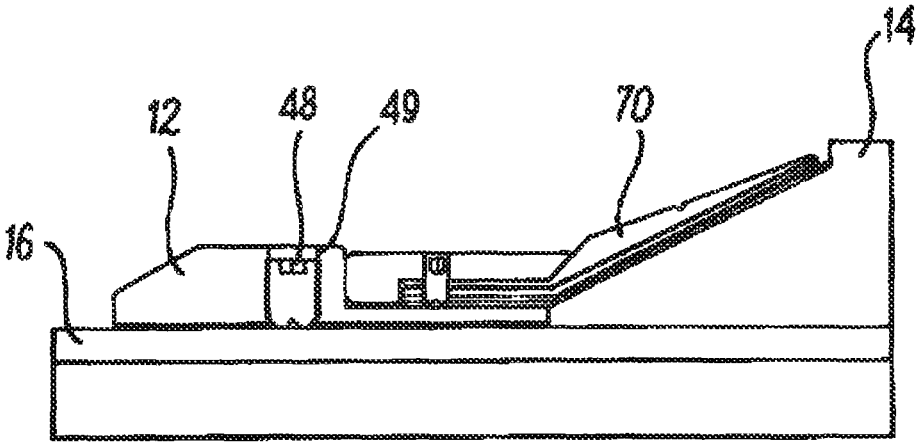
FIG. 5B is a detail of a longitudinal section through the well packer of FIGS. 3 and 4 in an expanded condition.

FIG. 5B shows the support structure 70 and swellable member 14 in an expanded condition. The support structure 70 is deployed to its expanded condition by expansion of the swellable member after exposure to wellbore fluids. The expanded portion 76 forms a frusto-conical portion 84 around an end of the swellable member 14.

The support structure 70 functions to moderate the effect of shear forces on the swellable member that would, were it not for the support structure 70, be exerted in an uncontrolled manner on the swellable member. The material of the swellable member will have a tendency to extrude over the adjacent end connector 12, and may have a tendency to split at the shoulder defined by the end connector 12. The overlapping arrangement of leaves 78 and the inner and outer layers 80, 82 resists extrusion of the swellable member 12 through gaps between adjacent leaves. The flexible lining 71 further assists with mitigating the extrusion of the swellable member through the support structure 70.

Figure 6:
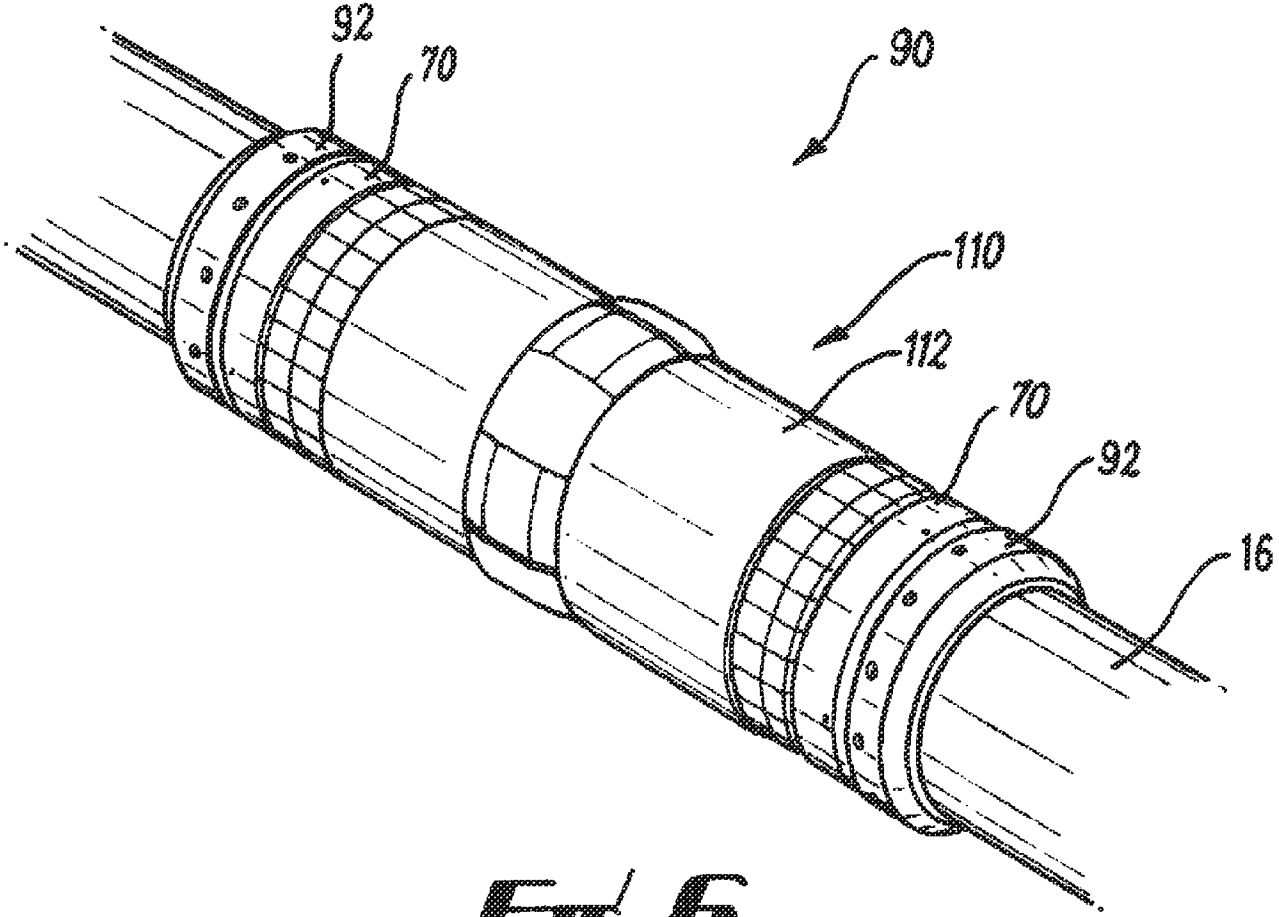
FIG. 6 is a perspective view of the support structure in used on a centraliser in accordance with an embodiment of the invention.
Figure 7A:
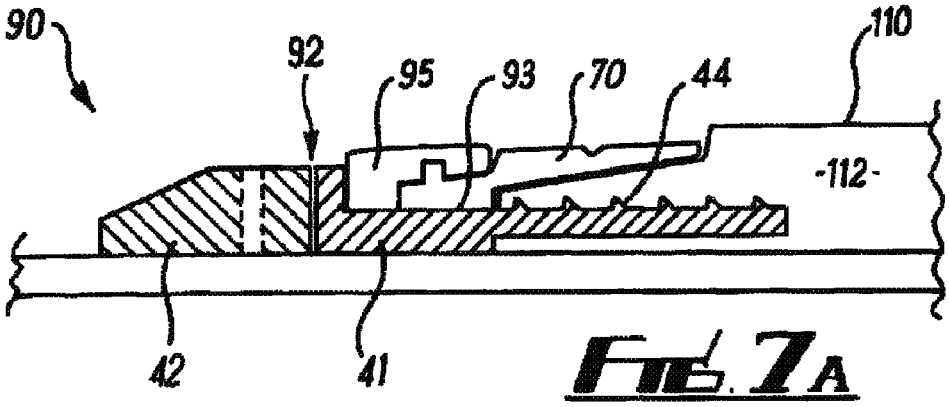
FIGS. 7A to 7C are details of longitudinal sections through assembly of FIG. 6 in respectively unexpanded, expanded and fully expended conditions.

FIGS. 6 and 7A show the support structure 70 in use in an assembly, generally depicted at 90, with an apparatus consisting of a centraliser 110 on a tubular 16. The support structure 70 is located on end connector 92, which is similar to the end connector 12. However, the end connector 92 differs in that the mating portion 41 and a retaining portion 42 are separate components. A ridged profile 44 is provided towards one end of the mating portion 41, which corresponds to a mating profile in a recess in the swellable member 112. The opposing end of the mating portion 41 provides a bearing surface 45, which abuts a corresponding bearing surface 46 of the retaining portion 42. The mating portion 41 defines an enlarged bore for receiving the inner parts of the swellable member 112. The retaining portion 42 also has fixing means in the form of bolts 48 that threadedly engage with bores 49 at locations spaced apart circumferentially around the external surface to secure the connector to a tubular.

When used with the end connector 92, the centraliser 110 will be rotatable on the tubular 16. The mating portion 41 is coupled to the centraliser and rotates with the centraliser on the tubular and relative to the retaining portion 42. The retaining portion 42 prevents axial movement of the centraliser on the tubular.

In another embodiment (not illustrated), an end connector may be used which is similar to the end connector 92, except that the mating portion and retaining portion are integrally formed or of unitary construction to prevent the mating portion 41 and the coupled apparatus from rotating on the tubular.

Figure 4:
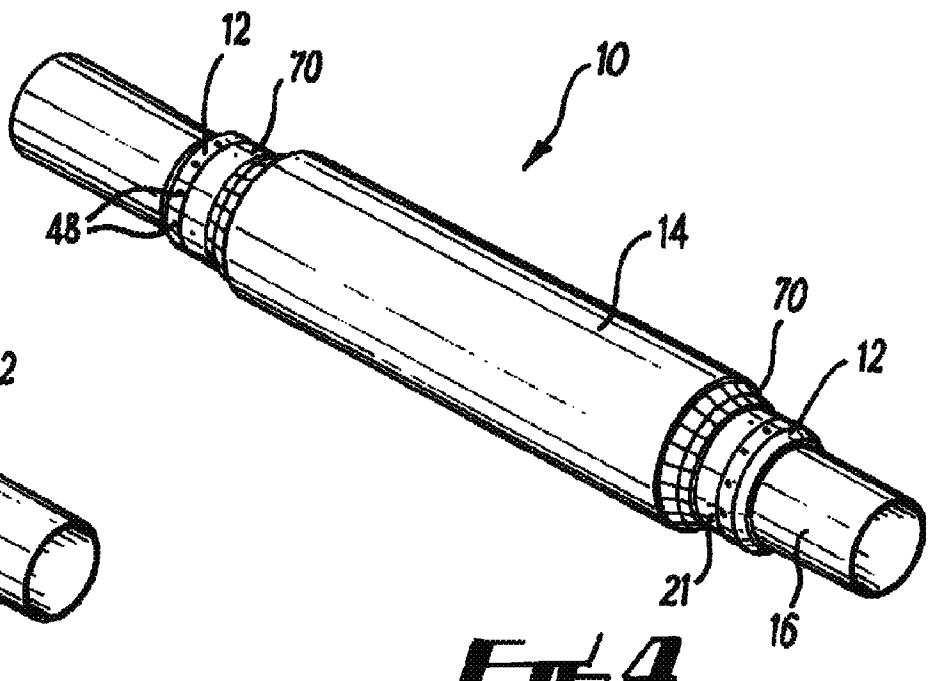
FIG. 4 is a perspective view of the support structure in use on the well packer of FIG. 3 in an expanded condition.
Figure 3:
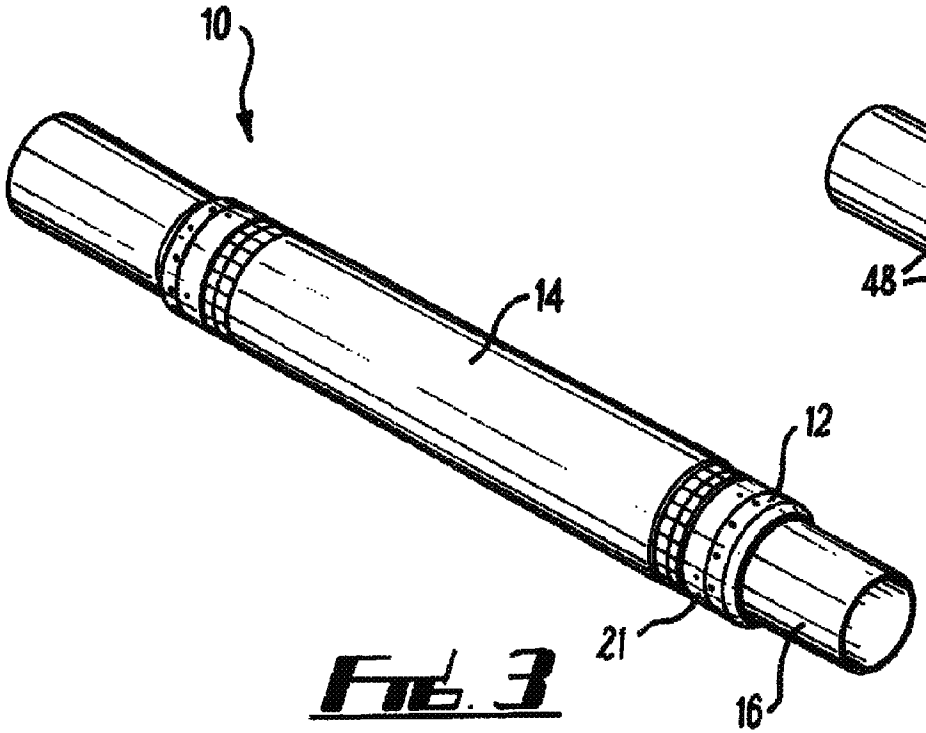
FIG. 3 is a perspective view of a support structure in use on a well packer in an unexpanded condition.

As with the embodiment of FIGS. 3 to 5, the cylindrical portion 72 of the support structure 70 is secured to the connector 92, and the expanding portion 76 is arranged to partially surround the swellable member 112. The swellable member 112 is profiled to accommodate the expanding portion 76, and such that the outer profile of the support structure 70 is flush or recessed with respect to the maximum outer diameter of the swellable member 112.

Figure 7B:
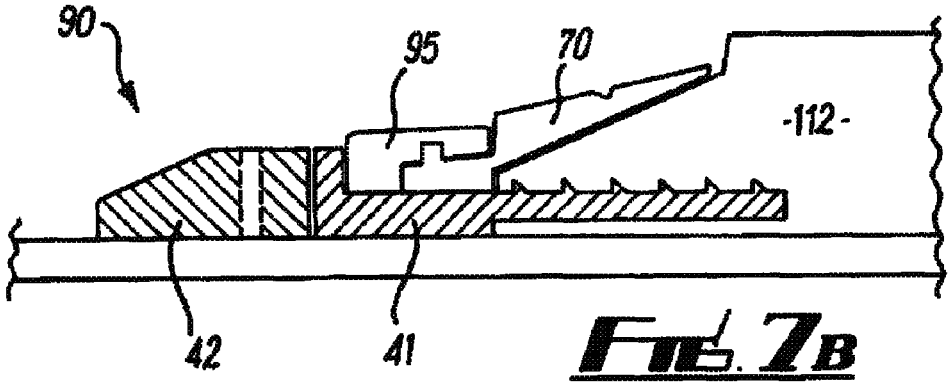

FIG. 7B shows the support structure 70 and swellable member 12 in an expanded condition. The support structure 70 is deployed to its expanded condition by expansion of the swellable member after exposure to wellbore fluids. The expanded portion 76 forms a frusto-conical portion 84 around an end of the swellable member 112.

Figure 7C:
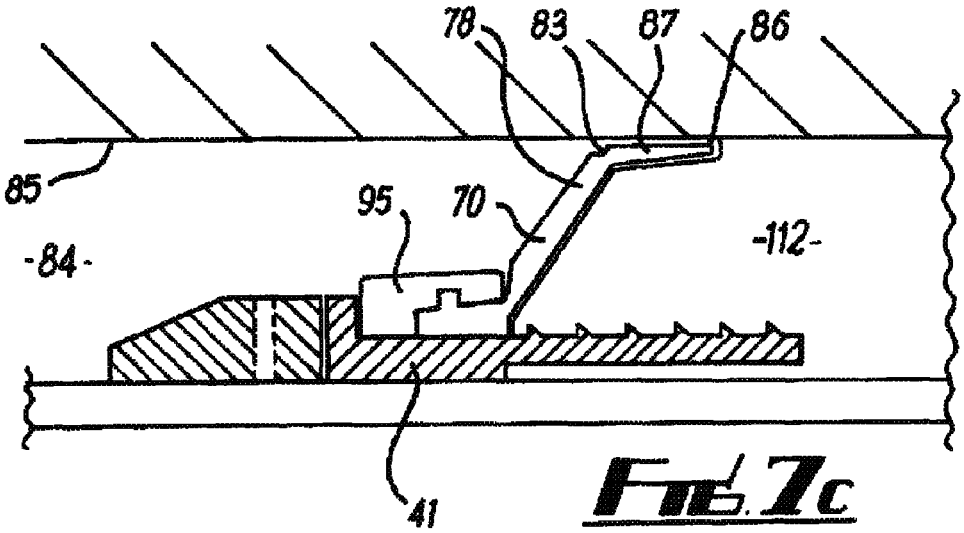

FIG. 7C shows the assembly 90 in an expanded condition where the support structure 70 is fully expanded against the inner wall 85 of a bore 84 in which the assembly is located. The ends 86 of the leaves 78 have been expanded into contact with the wall 85.

The support structure 70 is further deployed by these axial forces on the tubular and apparatus, which are manifested as shear forces on the swellable member. These forces, along with continued expansion or extrusion of the swellable member 12, tend to cause the leaves 78 to deform or fold about the line of the groove 83. The distal bearing portions 87 of the leaves are then brought into contact with the wall 85, disposed between the swellable member and the bore. The support structure itself provides a substantially cylindrical contact with the bore wall along an axial distance. This arrangement is particularly effective at providing support to the swellable member and resisting deformation and shearing, and assists in creating and maintaining a seal of high integrity.

Figure 8:
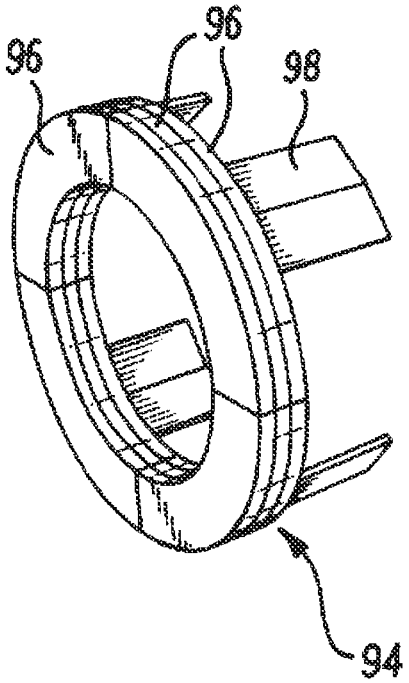
FIGS. 8 and 9 are perspective views of an alternative support structure in unexpanded and expanded conditions, respectively.
Figure 9:
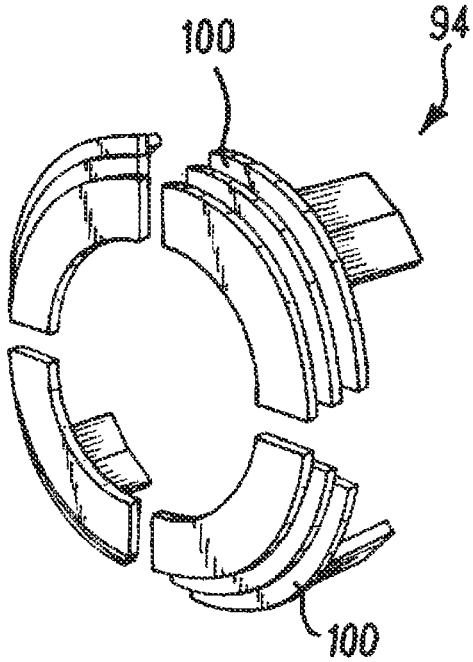

With reference now to FIGS. 8 and 9, there is shown generally depicted at 94, a support structure in accordance with an alternative embodiment of the invention. FIG. 8 shows the support structure 94 in an unexpanded condition, and FIG. 9 shows the apparatus 94 in an expanded condition.

The support structure 94 is configured to be positioned between an external surface of a swellable member and a connector, similar to the retaining portion 42 of FIG. 7. The support structure is configured to abut the swellable member in an unexpanded condition and to remain in contact with the external surface as the swellable member expands. More specifically, the support structure 94 comprises a number of concentric support members 96, each of which defines a bore through which a tubular is received. One of the support members 96 has four support elements 98 which are spaced apart around and attached to the support member 96. The support elements 98 extend in a longitudinal direction such that they provide for an increase in area of contact between the rigid assembly and the swellable member. Each of the support elements 98 comprises four rigid support parts 100 that are configured for movement in relation to each other in a radial direction away from a tubular whereby expansion of the swellable member is accommodated.

It will be appreciated that the support structures of FIG. 1 or 8 may be used with other types of expanding apparatus, including but not restricted to a well packer or other annular seal, a hanging member or anchor, or a centralising apparatus.

In some embodiments, a protective layer, which may be of an elastomeric or plastic material, may be provided over the outer surface of the support structure to reduce the likelihood of parts of the support structure catching or snagging on obstructions or other objects located in the wellbore. This will also assist in the creation of a seal between the support structure and the inside surface of a bore in which the apparatus is located.

In a further variation to the above described embodiments of the invention, the support structure is at least partially embedded into the swellable member. In another, a layer of swellable material is provided over at least a part of the support structure. An alternative embodiment of the invention is configured to be coupled direct to a tubular on which the apparatus and support structure is located in use.

The present invention provides in one of its aspects a support structure for use with well packers or other expanding downhole apparatus. One of the advantages of the invention is the ability to provide a seal in the annulus of high pressure integrity per unit length of expanding member. This permits operation under high pressure or weight conditions, or alternatively allows a reduction in the length or number of packers used in a particular application having a required pressure rating.

The invention also allows an expanding apparatus to be used over a range of operating parameters. For example, by providing support to the expanding portion it may be acceptable to expand the apparatus to a greater degree. This facilitates use in a broader range of bore diameters.

Variations and modifications to the above described embodiments may be made within the scope of the invention herein intended.

What is claimed is:

1. A support structure for a downhole apparatus, the downhole apparatus having a radially expanding portion comprising a swellable elastomeric material selected to expand on exposure to at least one predetermined fluid, and the support structure comprising:

an attachment means for coupling to the apparatus; and a support portion, wherein the support structure has a first unexpanded condition and a second expanded condition, and wherein the support structure is operable to be deployed to its second expanded condition by expansion of the radially expanding portion of the apparatus, and wherein the support structure comprises at least one layer of pivoting support members arranged circumferentially on the support structure.

2. The support structure as claimed in claim 1, wherein the support structure is configured to abut against a surface of the radially expanding portion before and during expansion of the radially expanding portion.

3. The support structure as claimed in claim 1, wherein the support structure is further configured to extend along a part of the length of the radially expanding portion.

4. The support structure as claimed claim 1, wherein the support structure is further configured to couple the apparatus to a tubular via the attachment means.

5. The support structure as claimed in claim 1, wherein the support portion further comprises:

a plurality of support members arranged to be moveable with respect to one another in order to accommodate expansion of the radially expanding portion.

6. The support structure as claimed in claim 5, wherein the support members are circumferentially arranged on the attachment means and extend longitudinally with respect to the attachment means.

7. The support structure as claimed in claim 5, wherein the support members are moveable in a radial direction.

8. The support structure as claimed in claim 5, wherein the support structure is deployed to its second expanded condition by moving distal ends of the support members radially with respect to the attachment means.

9. The support structure as claimed in claim 5, further comprising:

a first inner layer of support members arranged circumferentially on the support structure; and a second outer layer of support members arranged circumferentially on the support structure and disposed around the first inner layer.

10. The support structure as claimed in claim 9, wherein the first and second layers are arranged to overlap such that there is no direct path from an inner volume defined by the support portion and an outer surface of the support portion.

11. The support structure as claimed in claim 1, further comprising:

a lining disposed between the apparatus and the support portion in use.

12. The support structure as claimed in claim 11, wherein the lining includes a plurality of layers.

13. The support structure as claimed in claim 11, wherein the lining includes a plurality of leaves.

14. The support structure as claimed in claim 9, further comprising:

a lining disposed between the apparatus and the support portion in use.

15. The support structure as claimed in claim 14, wherein the lining includes a plurality of layers.

16. The support structure as claimed in claim 14, wherein the lining includes a plurality of leaves.

17. The support structure as claimed in claim 1, wherein the support portion comprises:

one or more formations which allow the support portion to at least partially conform to the shape of an inner surface of a bore in which it is located in use.

18. The support structure as claimed in claim 1, wherein a part of an outer surface of the support structure has a layer of swellable material formed thereon.

19. A downhole assembly comprising:

a downhole apparatus; and at least one support structure as claimed in claim 1 coupled to the apparatus.

20. The downhole assembly as claimed in claim 19, wherein the downhole apparatus comprises a connector, and wherein the support structure is coupled to the connector.

21. The downhole assembly as claimed in claim 19, wherein the apparatus is configured to rotate on a tubular, and wherein the support structure is configured to rotate on the tubular with the apparatus.

22. The downhole assembly as claimed in claim 19, wherein the apparatus is one of: a well packer, a hanging member, an anchor or a centralising apparatus.

23. A method of expanding an apparatus in a wellbore, the method comprising the steps of:

providing the apparatus at a downhole location in a first, unexpanded condition; and effecting the expansion of an expanding portion of the apparatus by exposing a swellable elastomeric material of the expanding portion to at least one predetermined fluid selected to swell the expanding portion, such expansion thereby deploying a support structure to an expanded condition in which it provides support to the expanding portion, wherein deploying the support structure comprises pivoting at least one layer of support members arranged circumferentially on the support structure.

24. The support structure as claimed in claim 1, further configured to at least partially surround an end of the radially expanding.

25. The support structure as claimed in claim 1 further configured to substantially cover an end of the radially expanding portion.

26. The support structure as claimed in claim 1 wherein the radially expanding portion is of cylindrical form and defines a longitudinally extending bore.

27. The support structure as claimed in claim 1, wherein the support structure defines a substantially cylindrical sheath in its first condition.

28. The support structure as claimed in claim 1, wherein the support structure defines an expanded sheath in its second condition, the expanded sheath comprising a frusto-conical portion.

29. The support structure as claimed in claim 1 wherein the support portion is arranged such that in use a force experienced from the radially expanding portion tends to move the support portion radially outward of the apparatus.

30. The support structure as claimed in claim 1 wherein the support portion comprises a bearing portion arranged to bear against an inner surface of a bore in which it is located in use.

31. A support structure for a downhole apparatus, the downhole apparatus having a radially expanding portion comprising:

a swellable elastomeric material selected to expand on exposure to at least one predetermined fluid, and the support structure comprising:

an attachment means for coupling to the downhole apparatus; and a support portion, comprising:

a first inner layer of support members arranged circumferentially on the support structure; and a second outer layer of support members arranged circumferentially on the support structure and disposed around the first inner layer, wherein the support structure has a first unexpanded condition and a second expanded condition, and wherein the support structure is operable to be deployed to its second expanded condition by expansion of the radially expanding portion of the apparatus.

32. The support structure as claimed in claim 31, wherein the support structure is configured to abut against a surface of the radially expanding portion before and during expansion of the radially expanding portion.

33. The support structure as claimed in claim 31, further configured to at least partially surround an end of the radially expanding portion.

34. The support structure as claimed in claim 31 further configured to substantially cover an end of the radially expanding portion.

35. The support structure as claimed in claim 31 wherein the radially expanding portion is of cylindrical form and defines a longitudinally extending bore.

36. The support structure as claimed in claim 31, wherein the support structure in the first unexpanded condition defines a substantially cylindrical sheath.

37. The support structure as claimed in claim 31, wherein the support structure in the second expanded condition defines an expanded sheath, the expanded sheath comprising a frusto-conical portion.

38. The support structure as claimed in claim 31, further configured to couple the apparatus to a tubular via the attachment means.

39. The support structure as claimed in claim 31 wherein the support portion comprises a plurality of support members, arranged to be moveable with respect to one another to accommodate expansion of the radially expanding portion.

40. The support structure as claimed in claim 39 wherein the support members are circumferentially arranged on the attachment means, and are arranged to extend longitudinally with respect to the attachment means.

41. The support structure as claimed in claim 39, wherein the support structure is deployed to the second expanded condition by moving distal ends of the support members radially with respect to the attachment means.

42. The support structure as claimed in claim 31 wherein the first and second layers are arranged to overlap such that there is no direct path from an inner volume defined by the support portion and an outer surface of the support portion.

43. The support structure as claimed in claim 31 further comprising a lining disposed between the apparatus and the support portion in use.

44. The support structure as claimed in claim 43 wherein the lining includes a plurality of layers.

45. The support structure as claimed in claim 43 wherein the lining includes a plurality of leaves.

46. The support structure as claimed in claim 31 wherein the support portion is arranged such that in use a force experienced from the radially expanding portion tends to move the support portion radially outward of the apparatus.

47. The support structure as claimed in claim 31 wherein the support portion comprises a bearing portion arranged to bear against an inner surface of a bore in which it is located in use.

48. The support structure as claimed claim 47 wherein the support portion comprises one or more formations which allow the support portion to at least partially conform to the shape of an inner surface of a bore in which it is located in use.

49. The support structure as claimed in claim 31, wherein a part of the outer surface of the support structure has a layer of swellable material formed thereon.

50. A downhole assembly comprising a downhole apparatus and at least one support structure as claimed in claim 31 coupled to the downhole apparatus.

51. The downhole assembly as claimed in claim 50, wherein the downhole apparatus comprises a connector, and wherein the support structure is coupled to the connector.

52. The downhole assembly as claimed in claim 51, wherein the apparatus is configured to rotate on a tubular and wherein the support structure is configured to rotate on the tubular with the apparatus.

53. The downhole assembly as claimed in claim 51, wherein the apparatus is selected from a well packer, a hanging member, an anchor and a centralising apparatus.

54. A method of expanding an apparatus in a wellbore, the method comprising the steps of:

providing the apparatus at a downhole location in a first, unexpanded condition;

effecting the expansion of an expanding portion of the apparatus by exposing a swellable elastomeric material of the expanding portion to at least one predetermined fluid selected to swell the expanding portion, such expansion thereby deploying a support structure;

and wherein deploying the support structure comprises deploying a first inner layer of support members and deploying a second outer layer of support members and disposed around the first inner layer to an expanded condition in which they provide support to the expanding portion.

* * * * *